United States Patent [19]

McCoy

[11] 4,389,286

[45] Jun. 21, 1983

[54] ALKALINE PLATING BATHS AND ELECTROPLATING PROCESS

[75] Inventor: Ewald H. McCoy, Brookfield, Wis.

[73] Assignee: Electrochemical Products, Inc., New Berlin, Wis.

[21] Appl. No.: 426,067

[22] Filed: Sep. 28, 1982

Related U.S. Application Data

[63] Continuation-in-part of Ser. No. 169,752, Jul. 17, 1980, Pat. No. 4,356,067, and a continuation-in-part of Ser. No. 48,265, Jun. 13, 1979, abandoned.

[51] Int. Cl.[3] ..... C25D 3/32; C25D 3/36; C25D 3/58

[52] U.S. Cl. ..... 204/44; 204/43 S; 204/53; 204/54 R; 204/DIG. 2

[58] Field of Search ..... 204/44, 53, 54 R, 43 S

[56] References Cited

U.S. PATENT DOCUMENTS 2,700,646 1/1955 Chester ..... 204/44
3,111,465 11/1963 Passal ..... 204/44
3,219,560 12/1965 Leenders et al. ..... 204/52
3,616,291 10/1971 Wilson ..... 204/27
3,642,591 2/1972 Boose et al. ..... 204/55 R

FOREIGN PATENT DOCUMENTS 2635560 11/1977 Fed. Rep. of Germany .

OTHER PUBLICATIONS

Ratajczak, L'Industrie Chimique, vol. 56, pp. 35, 36, (Feb. 1969).

*Primary Examiner*—F. Edmundson
*Attorney, Agent, or Firm*—Quarles & Brady

[57] ABSTRACT

Cyanide-free plating baths for the electrodeposition of copper alloys comprise aqueous alkaline mixtures which contain copper and either lead or tin ions and a chelating agent selected from glucoheptonic acid and its salts. Processes for electroplating using the bath and for removing the metal ions from the spent baths by pH adjustment are also disclosed.

8 Claims, No Drawings

ALKALINE PLATING BATHS AND ELECTROPLATING PROCESS

RELATED CASES

The present application is a continuation-in-part of my earlier copending application Ser. No. 169,752 filed July 17, 1980, now U.S. Pat. No. 4,356,067 and my abandoned application Ser. No. 48,265 filed June 13, 1979.

FIELD OF THE INVENTION

The present invention relates generally to the field of electroplating and more particularly to electroplating surfaces with copper and tin and copper and lead alloys.

BACKGROUND OF THE INVENTION

Electroplating is a process for putting a metallic plate or coating on a conducting surface by using an electric current. The surface to be plated is connected to the negative end of a source of electricity and it is placed in a plating solution containing ions of the metal with which it is to be plated. The conducting surface to be plated when thus connected is referred to as the "cathode". The positive end of the electrical source is connected to another conductor which is of the same composition as the metal plate desired. It is commonly referred to as the "anode" and it is also placed in the plating bath. A direct electrical current is passed through the bath to separate metal ions from the plating bath and cause the metal to be deposited on the cathode.

Alkaline plating baths containing cyanide are employed for the commercial electrodeposition of most copper alloys, such as, brass which contains approximately 70% copper and 30% zinc, white brass which contains 50% zinc and about 50% copper, high copper alloys which contain about 90% copper and 10% zinc, bronze which contains copper and tin and copper and lead alloys.

The use of alkaline cyanide plating baths present spent bath disposal problems. Before the spent cyanide baths or subsequent rinses can be discarded, they must meet pollution control effluent requirements which requires costly cyanide destruction. Therefore, a need exists for a cyanide-free plating bath for the electroplating of copper alloys.

In my earlier applications, I disclosed cyanide-free plating baths which can be used for the commercial electrodeposition of copper and zinc alloys. However, a need also exists for cyanide-free plating baths for copper-tin (bronze) and copper-lead alloys.

SUMMARY OF THE INVENTION

The primary objects of the present invention are to disclose novel cyanide-free alkaline plating baths and a process for electrodepositing copper and tin and copper and lead alloys from said baths.

It is also an object to disclose a process for simply and effectively removing the metal ions from a spent plating bath of the present invention.

Finally, it is an object of this invention to disclose alkaline plating baths which make unnecessary the costly cyanide destruction procedures which are required for the effluent from cyanide baths to meet pollution discharge requirements.

The novel plating baths of the present invention are aqueous mixtures containing a suitable source of the metal ions, such as a mixture of copper and tin salts or copper and lead salts, a chelating agent selected from glucoheptonic acid and its salts, which chelating agent is present in an effective amount which is in excess of the stoichiometric equivalent of at least one of the metal ions and sufficient base to render the mixture alkaline.

The plating bath for copper and tin alloys contains in each liter about 20.0 grams to about 30.0 grams of copper; about 1.25 to about 6.0 grams of tin; about 10 grams to about 75 grams of the chelating agent and about 2 to about 10 grams of caustic and it has a pH of about 12 to about 13.5.

The plating bath for copper and lead alloys contains in each liter about 20.0 to about 30.0 grams of copper; about 0.05 to about 1.5 grams of lead; about 10 grams to 75 grams of the chelating agent and about 20 grams to about 50 grams of caustic and it has a pH of about 10 to about 11.5.

The chemicals for the baths are preferably supplied as an aqueous concentrate which is diluted with 4 parts of water to yield the plating bath.

The process of the present invention for electrodepositing copper and tin or copper and lead alloys is basically the same. It comprises preparing a plating bath of the desired composition, connecting the conductive surface to be plated to the negative end of a source of electricity to form a cathode, placing the cathode in the plating bath, and inserting into the bath a copper anode or an anode of the same alloy being plated. The anode is connected to the positive end of a source of electricity. When the cathode and anode are in place a direct current is passed through the bath to electrically deposit the metal alloy upon the cathode.

The excess metal ions are removed from the spent plating baths by introducing carbonate ions into the spent bath and reducing the pH of the bath to about 8.5 to precipitate the metal and carbonate ions as a readily removable sludge.

Other objects and advantages of this invention will appear from the description which follows:

DESCRIPTION OF PREFERRED EMBODIMENTS

The plating bath chemicals are preferably supplied as an aqueous concentrate which is diluted with 4 parts of water to make the plating bath.

The plating bath for plating copper-tin alloys may have the following composition:

| | Optimum | Range |
|---|---|---|
| Copper | 24.0 grams/liter | 20.00–30.0 grams/liter |
| Tin | 3.5 grams/liter | 1.25–6.0 grams/liter |
| Caustic (KOH) | 3.0 grams/liter | 2.00–10.0 grams/liter |
| Chelating Agent | 20.0 grams/liter | 10.00–75.0 grams/liter |

The plating bath for copper-lead alloys may have the following composition:

| | Optimum | Range |
|---|---|---|
| Copper | 24.0 grams/liter | 20.00–30.0 grams/liter |
| Lead | 0.4 grams/liter | 0.05 –1.5 grams/liter |
| Caustic (KOH) | 37.5 grams/liter | 20.00–50.0 grams/liter |
| Chelating Agent | 20.0 grams/liter | 10.00–17.0 grams/liter |

The plating solution is made up as follows:

The tank capacity is calculated (allowing for the filter and related heating equipment) and the quantity is divided by five. The resultant figure is the amount of concentrate required to make up the plating bath. This is added to the tank and water is added to near the final volume. Brighteners and other addition agents may be added. After a temperature check and a short electrolysis at 10 ASF. the bath is ready for operation.

The preferred baths described above, require either bar anodes or titanium baskets with ball anodes. Steel should not be allowed to come in contact with the plating solution as it will dissolve slowly under reverse current conditions.

Plating with the baths of the present invention requires a clean lined plating tank and related equipment. Rubber, Koroseal or other plastic tanks are suitable. When the bath is used in tanks that have previously been used for cyanide plating the tank, anodes, anode bars must be free of cyanide. After the removal of the old cyanide bath the equipment should be washed with hypochlorite solution and the tank soaked for 24 hours in 2% sodium hypochlorite to destroy all cyanide. Hoods, barrels, and filtering equipment must also be free of cyanide. After removal of the hypochlorite solution and rinsing, a dilute 1% to 2% sulphuric acid rinse should follow and after rinsing with water a 5% caustic rinse should be used to eliminate the acid. The caustic rinse should be removed and the concentrated solution added and diluted for use.

Control of the caustic content of the bath is the most frequent adjustment required. The caustic content should be checked daily and corrected (this takes place of the cyanide check in usual brass solutions). The analysis only takes minutes and should not be ignored. Control of the caustic is very important for anode corrosion. Liquid KOH is the preferred caustic because of ease of addition.

The metal content of the bath is replenished by adding the bath concentrate whenever the copper metal content decreases. Adding additional bath concentrate also adds caustic. Caustic adjustments should be made, if required, after a metal addition if analysis shows the caustic to be below the desired level. Adding concentrate automatically adjusts the other chemical components.

The amounts of brighteners and other addition agents to be added may be effected by the ampere hours plated and will depend upon the addition agent, the alloy being plated and other factors known to those skilled in the art. The additions may be made every 4 hours or by automatic feed for best and most economical results.

Determination of the copper ion and caustic levels is done by simple analytical procedures developed especially for the process.

The analytical procedures employed are the following:

(a) COPPER METAL

1. Place 5 ml sample in a 250 ml flask.
2. Add 50 cc deionized or distilled water.
3. Add 2 to 3 grams ammonium persulfate.
4. Add 5 mls ammonium hydroxide (conc.) (Let stand for 10 minutes.)
5. Add 10 drops pan indicator. (Do not add more than 10 drops as the end point is affected.)
6. Just before titrating add 5 grams chloral hydrate, swirl to dissolve crystals.
7. Titrate immediately with 0.1 M EDTA solution to an apple green end point. Calculation: [1.74×(mls of 0.1 M EDTA)] divided by 5, minus [2 times the other metal in the alloy]×0.488=oz/gal Cu Metal.

(b) KOH

1. Place 5 ml sample in a 250 ml flask.
2. Add 10 mls deionized or distilled water.
3. Add 3 to 5 grams sodium cyanide and swirl, (solution should now be clear and pale green.)
4. Add 8 to 10 drops LaMotte Sulfo Orange Indicator and 1 or 2 drops Alkali Blue Indicator.
5. Titrate with 1.0 N HCl to a green end point. Color change is from a brown-orange to a green. Calculation: mls of 1.0 N HCl×1.5=oz/gal KOH The solutions required for above analytical procedures are the following:

(a) Pan Indicator

Weigh out 0.1 gram of 1-(2-Pyridylazo-Napthol) and dissolve in 100 mls of denatured alcohol.

(b) EDTA (0.1 Molar)

On analytical balance weigh out 37.2398 grams of EDTA (Ethylenediamine-tetra-acetic acid, disodium salt). Dilute to 1000 mls with deionized or distilled water in a volumetric flask. Allow this solution to stand over night. EDTA crystals should be completely dissolved.

(c) HCl (1.0 N)

Measure out 83 mls of concentrated hydrochloric acid into 900 mls of deionized or distilled water. Using a 1000 ml volumetric flask dilute to the mark with deionized or distilled water. Let stand for a day. Standardize the solution.

The copper ions in the bath may be supplied by using water soluble salts such as the sulfate, chloride, fluoroborate, fluorosilicate and fluoride. Other copper compounds which can be used include carbonates, phosphates, pyrophosphates and hydroxides. Especially preferred for use are the mono or polycarboxylic aliphatic acid salts or mono or polyhydroxy aliphatic acid salts of copper. Such salts are not generally available in large enough quantities to allow their commercial use, however they can be formed in situ. It is well known that as long as the metal ions are present, i.e. copper and hydroxide for example, and an organic acid such as acetic acid is introduced that the resultant reaction produces the carboxylic aliphatic acid salt of copper and water.

The preferred lead salt is lead acetate; however, other soluble lead salts may be used. The preferred tin salt is sodium stanate; however, any other salt soluble in the alkaline solution can be used, such as fluoroborate.

Generally speaking, any salt can be used to supply the metal ions which does not contain other ions which interfere with the electroplating process. For example, chromate or cyanide salts would not be suitable as sources of the metal ions, as the chromate would inhibit the metal deposition and the cyanides would introduce cyanide ions into the plating bath and defeat an important purpose of the invention.

The chelating agents which can be used in the practice of the present invention are glucoheptonic acid and its alkali metal salts. Although the sequestering or chelating abilities of the glucoheptonic acid and its salts has been known for some time, such compounds have only been used in the past in plating baths in relatively small amounts to chelate undesirable metal ions introduced by impurities or as a means of chelating small amounts of desirable metals used as grain refiners and brighteners. In the baths of the present invention the chelating agents are used in much higher quantities which maintain in the bath a reservoir of metal ions of sufficient concentration to permit the electrodeposition of the particular metal over a wide range of operating conditions. For this purpose it is necessary that the plating bath contain an amount of chelating agent which is in excess of a stoichiometric equivalent of the copper. The preferred chelating agent is the sodium salt of glucoheptonic acid (sodium 1,2,3,4,5,6, hexahydroxy hexane-1-carboxylate). If desired, the bath may contain additional chelating agents.

Preferred plating bath formulations of the present invention at a temperature of 40° C. are the following:

| | |
|---|---|
| COPPER/TIN | |
| Copper as carbonate | 24.0 g/L |
| Sodium Stanate | 3.5 g/L |
| $CH_2OH(CHOH)_5COONa$ | 20 g/L |
| KOH | 3.0 g/L |
| COPPER/LEAD | |
| Copper as carbonate | 20 g/L |
| Lead as acetate | 0.4 g/L |
| $CH_2OH(CHOH)_5COONa$ | 20 g/L |
| KOH | 37.5 g/L |

The electrodeposition of the copper and tin and copper and lead alloys over a wide range of temperatures using the above formulations was evaluated. As a result it was found that the metals could be deposited at temperatures ranging from approximately 20° C. to 65° C. However, for most purposes a temperature range of 30° to 50° C. provides a range in which the metals of the alloys may be codeposited depending upon bath composition and other operating conditions.

The electroplate as deposited on the Hull Cell Panel using the above preferred copper/tin plating bath had good ductility—when tested it showed an average composition of 96% copper and 4% tin. The plate obtained was smooth and acceptable for commercial applications. To increase the percentage of tin in the deposit, the amount of tin in the bath, the operating temperature or the alkalinity can be increased. Conversely, lowering the concentration of tin, the temperature or the alkalinity lowers the tin content of the deposit.

The electroplate as deposited on the Hull Cell panel using the preferred copper/lead plating bath showed an average composition of 97% copper and 3% lead. The composition of the alloy can be varied by varying the proportions of the lead in the solution. For example, by raising the lead concentration to 0/8 g/L, the alloy deposited was 90% copper and 10% lead.

The bases that may be used to adjust the pH of the plating baths are preferably the alkaline metal hydroxides of sodium, potassium and lithium. The use of ammonium hydroxide is not recommended because it does not increase the pH to the level required for successful operation of the inventive process. In addition, ammonium hydroxide is difficult to remove as the copper complex from the effluent in the pollution treatment process. In addition to the alkaline metal hydroxides, amines also may be used but they also can cause difficulties in the subsequent pollution treatment process.

A convenient process for removing metal ions from a spent bath of the present invention involves introducing carbonate ions into the spent bath. When carbonate ions are added to the spent bath and the pH of the bath is reduced to about 8.5, a reduction in chelating power causes the remaining metal ions to precipitate as carbonates allowing for their easy removal as sludge. This facilitates upgrading the effluent without requiring the usual costly cyanide destruction process which is required with alkaline cyanide baths.

In the process of plating objects, which employs the previously described plating baths, the object to be plated is connected to the negative end of a source of electricity as the cathode and an anode of the desired metal or metal alloy is connected to the positive end of the electrical source. A direct current is then passed through the solution resulting in an electrodeposit of a uniform plate or layer of metal upon the cathode.

The tank voltages and amperages used in the process are similar to those used on cyanide processes; 2–6 volts on tank operations and 9–12 volts on barrel operations. The plating is preferably conducted at about 40° C., with either mild air or cathode agitation in the tank or barrel agitation at 2–6 RPMs. For best results filtering must be continuous for smooth plating and the filter should be lined or of non-metallic construction. Ventilation is required because of the caustic nature of the solution.

The plate of alloy obtained through practice of the invention is uniform and acceptable for many purposes, however, it may be duller in appearance than desired or lock other desired properties. If so, addition agents may be added to the plating bath prior to use. The addition of a brightener promotes a bright, smooth uniform deposit which may be more commercially desirable.

Among the compounds which have been found to enhance the properties of the deposited metal plates are the following which normally would be used with a suitable wetting agent.

(a) The metal ions of zinc (0.1 to 2.5 ppm), selenium in (0.25–10 ppm) and tellurium (1–10 ppm). These have the greatest brightening effects. They may be used alone or in combination with each other.

(b) The ions of bismuch and antimony have a lesser but still beneficial effect and may be used in larger quantities to augment the first group. The effective range being 1 to 15 ppm.

(c) The ions of some of the precious metals such as indium, gold, or silver might be used but their cost precludes their practicability and their effect is not as great as those first mentioned. Effective concentration of the precious metal ions is in the range of 1 to 10 ppm.

It also has been found, that in addition to the aforementioned metal ions, certain organic compounds act in a cooperative manner with the desirable trace metal ions to enhance the electrodeposit. The quantity of compound required will vary with the compound selected.

The organic compounds which have been found to further enhance brightness are sulfur containing compounds. Compounds having mercaptan groups (C—SH) and the C=S groups have been found to be effective as auxiliary brightening agents when used in the process. Examples of compounds having mercaptan groups include dl homocystine (2-amino, 4-mercaptobutyric acid), 2-mercaptoethanol, and 2-mercaptobenzimidazole. Examples of useful compounds having the C=S group include cystine, and dl homocystine. Organic sulfur containing compounds having 5 carbons or less are generally not useful with copper/-lead alloys because they form lead sulfide which precipitates to form roughness in the plate.

Useful compounds which have carbon chains of greater than 5 carbons include those in which the general formula is:

#1

$$R_2-\underset{H}{\overset{R}{C}}-CH_2-S-CH_2-\underset{H}{\overset{R_1}{C}}-R_2$$

| | |
|---|---|
| where $R_1 = \overline{O}H$ | and $R_2 = -\overset{O}{\overset{\|\|}{C}}-OH$ |
| $= {}^{+}NH_2$ | $= -CH_3$ |
| $= {}^{+}H$ | $= -CH_2\overset{O}{\overset{\|\|}{C}}-OH$ |
| $= {}^{+}CH_3$ | |

or the general formula of:

#2

$$R_2-\underset{H}{\overset{R_1}{C}}-CH_2-S-S-CH_2-\underset{H}{\overset{R}{C}}-R_2$$

| | |
|---|---|
| where $R_1 = OH$ | and $R_2 = \overset{O}{\overset{\|\|}{C}}-OH$ |
| $= NH_2$ | $= CH_3$ |
| $= H$ | $= CH_2\overset{O}{\overset{\|\|}{C}}-OH$ |
| $= CH_3$ | |

A typical example of #1 would be Cystathionine.

A typical example of #2 would be Cystine.

These compounds are used in amounts of 0.25 ppm to 2.5 ppm.

Other sulphur bearing compounds which showed brightening effects with less effectiveness were thiobenzanilide, 5-sulfosalicylic acid and sulfamide. These compounds are preferably used in amounts of 0.1 to 5 ppm as auxiliary brighteners.

The concentrates used to prepare the copper and lead or copper and tin plating baths can include the addition agents mentioned or the addition agents may be added to the plating baths as water soluble compounds.

My discovery of the plating baths of the present invention is a significant advance in the field of electroplating because the baths make possible the economical commercial plating of copper and tin and copper and lead alloys of commercially acceptable quality without the use of baths containing cyanide ions or special equipment. In addition, my plating baths provide all the advantages previously obtained only with cyanide baths without the pollution control problems associated with the use of such cyanide baths.

It will be readily apparent to those skilled in the art that the use of my plating baths also provides significant energy savings over the use of alkaline cyanide baths because there is no need when using my baths to destroy the cyanide ions. The spent baths of the present invention are simply adjusted to a pH of 8.5, the solution is treated with slaked lime, and sodium polysulfide is added to precipitate the remaining metals. The resulting effluent can be disposed of conventionally.

I claim:

1. A cyanide-free plating bath for the electrodeposition of copper containing alloys consists of an aqueous solution containing copper ions and ions selected from tin and lead ions, a chelating agent selected from glucoheptonic acid and salts thereof, and sufficient caustic to have a pH of about 10 to about 13.5.

2. A bath of claim 1 which contains copper and tin ions.

3. A bath of claim 1 which contains copper and lead ions.

4. A bath of claim 2, which contains 20 to 30 grams/liter of copper and 1.25 to 6.0 grams/liter of tin.

5. A bath of claim 3 which contains 20 to 30 grams/liter of copper and 0.05 to 1.5 grams/liter of lead.

6. A bath of claim 1 in which the chelating agent is the sodium salt of glucoheptonic acid.

7. A bath concentrate which upon dilution with water yields a plating bath of claim 1.

8. The method of electrodepositing a copper alloy selected from copper/tin and copper/lead alloys upon a conductive surface of an object which comprises connecting the conductive surface to the negative end of a source of electricity, placing the conducting surface in a plating bath of claim 1, placing into the same plating bath an anode which is connected to a positive end of a source of electricity and then passing an electrical current through the plating bath so that a plate of the desired alloy is deposited upon the conductive surface.

* * * * *

UNITED STATES PATENT AND TRADEMARK OFFICE

CERTIFICATE OF CORRECTION

PATENT NO. : 4,389,286

DATED : June 21, 1983

INVENTOR(S) : Ewald H. McCoy

It is certified that error appears in the above-identified patent and that said Letters Patent is hereby corrected as shown below:

The term of this patent subsequent to October 26, 1999 has been disclaimed.

Signed and Sealed this

Ninth Day of August 1983

[SEAL]

*Attest:*

GERALD J. MOSSINGHOFF

*Attesting Officer*

*Commissioner of Patents and Trademarks*